US006146160A

United States Patent [19]

Chang

[11] Patent Number: 6,146,160

[45] Date of Patent: Nov. 14, 2000

[54] STRUCTURE OF A SLIDING-TYPE SOCKET

[76] Inventor: Chi-Tsai Chang, P.O. Box 82-144, Taipei, Taiwan

[21] Appl. No.: 09/312,757

[22] Filed: May 17, 1999

[30] Foreign Application Priority Data

Nov. 10, 1998 [TW] Taiwan ..... 87218628

[51] Int. Cl.[7] ..... H01R 13/44

[52] U.S. Cl. ..... 439/137; 439/145

[58] Field of Search ..... 439/137, 135, 439/145, 147, 153, 155, 157; 361/345, 395, 344, 399; 174/67

[56] References Cited

U.S. PATENT DOCUMENTS

| | | | |
|---|---|---|---|
| 4,640,564 | 2/1987 | Hill | 439/137 |
| 4,726,780 | 2/1988 | Thackeray | 439/137 |
| 5,839,909 | 11/1998 | Calderara et al. | 439/137 |

*Primary Examiner*—Brian Sircus
*Assistant Examiner*—J. F. Duverne
*Attorney, Agent, or Firm*—A & J

[57] ABSTRACT

The present invention relates to an improved structure of a socket comprising a socket body, a framework, a mounting seat, and a covering board. The framework is mounted at the center of the socket body and at the lateral edge of the framework, a plurality of channels are provided for the mounting of the mounting seat. A positioning member being urged by elastic elements is mounted to a horizontal slot which is formed at the central bottom region of the mounting seat. The front end of the positioning member is extended and spaced by a protruded end to form a protruded stopping disc having a slanting edge, which works together with a horizontal bar so as to cause the positioning member to slide laterally. The lower section of the mounting seat is provided with an engaging board, having a bottom face being urged by an elastic element. At normal condition, the upward movement of the engaging board positions the positioning member to the two lateral edges of the framework. After the prongs of a plug are inserted into the socket, the engaging board is pressed downward which in turn causes the positioning member to elastically secure the prongs. Thus, the secured prongs will not dislocate from the socket.

5 Claims, 3 Drawing Sheets

STRUCTURE OF A SLIDING-TYPE SOCKET

BACKGROUND OF THE INVENTION (a) Field of the Invention

The present invention relates to an improved structure of a socket an in particular, to a sliding-type socket having a pair of slidable positioning disc being urged by a pair of elastic elements. When the prongs of a plug are inserted into the socket the positioning disc moves to a position to elastically engage the prongs from dislocating.

b) Description of the Prior Art

The essential function of a socket is to provide an extension of current supply to electrical appliances. The socket links a current supply from a power source to form a current supply delay station for the electrical appliances. Other than the stable current supply from a main power source, the stability of current supply of the socket is greatly depending on the stability of the socket. In the currently available sockets, the stability of these sockets depends on the clipping force of the conductive elements within the socket. As such, when the sockets have been used for a long time or the size of the prongs of a socket is not accurate with respect to the insertion hole of the socket, the retention or the clipping force of the conductive elements becomes weak or loose. In such case, when the socket or the plug of an electrical appliance is accidentally touched, the plug may disclose or fall off from the socket and thus, an interruption of current supply is occurred. To solve this problem, most of the people may widen or narrow the distance in between the two prongs of the plug so as to fix the prongs to the socket. By the adjustment of the distance of the prongs to be inserted into the socket, the clipping of the prongs may be improved. However, in actual practice, such adjustment does not improve the stability or the mounting capability of the socket. The prongs may be dislocated as a result of accidentally touch. The clipping of the prongs of the plug is greatly depending on the clipping force of the conductive elements within the socket. The above adjustment process may damage the structure of the plug, in particular, in the field of current supply to computers or the like, where the current supply cannot be interrupted. Unexpected interruption of current supply often causes a great loss to the user. To solve this problem, computer users or other major electrical appliances users, use a spare system when a current failure is occurred. However, this system is not applicable to an individual user. Thus, this method of solving the problem of the interrupted current supply is ineffective. In addition, this system is mainly designed to solve the current supply failure from the power source and not use to solve the problem of accidental touch of the socket.

The inventor of the present invention aims to solve the problem of the conventional sockets which provide ineffective retention of the prongs. In particular, the inventor aims to improve the structure of the sockets which cause the prongs to be exposed outside the socket and may cause electric shock if the prongs are accidentally touched.

SUMMARY OF THE INVENTION

The present invention relates to an improved structure of a socket comprising a socket body, a framework, a mounting seat, and a covering board. The framework is mounted at the center of the socket body and at the lateral edge of the framework, a plurality of channels are provided for the mounting of the mounting seat. A positioning member being urged by an elastic element is mounted to a pair of slots being formed at the central bottom region of the mounting seat. The front end of the positioning member is extended and spaced by a protruded end to form a protruded stopping disc having a slanting edge, which works together with a horizontal bar so as to cause the positioning member to slide laterally. The lower section of the mounting seat is provided with an engaging board, having a bottom face being urged by an elastic element. At normal condition, the upward movement of the engaging board positions the positioning member to the two lateral edges of the framework. After the prongs of a plug are inserted into the socket, the engaging board is pressed downward which in turn causes the positioning member to elastically secures the prongs. Thus, the secured prongs will not dislocate from the socket.

In accordance with the present invention, an improved structure of a sliding-type socket is provided which substantially eliminates or reduces disadvantages and problems associated with related prior art socket structures.

It is an object of the present invention to provide an improved structure of a sliding-type socket, wherein it encloses completely the prongs of a plug such that accidental contact with the prongs is made impossible.

It is yet another object of the present invention to provide an improved structure of a sliding-type socket, wherein the prongs of the plug are securely mounted within the socket.

DETAILED DESCRIPTION OF THE PREFERRED EMBODIMENT

Figure 1:
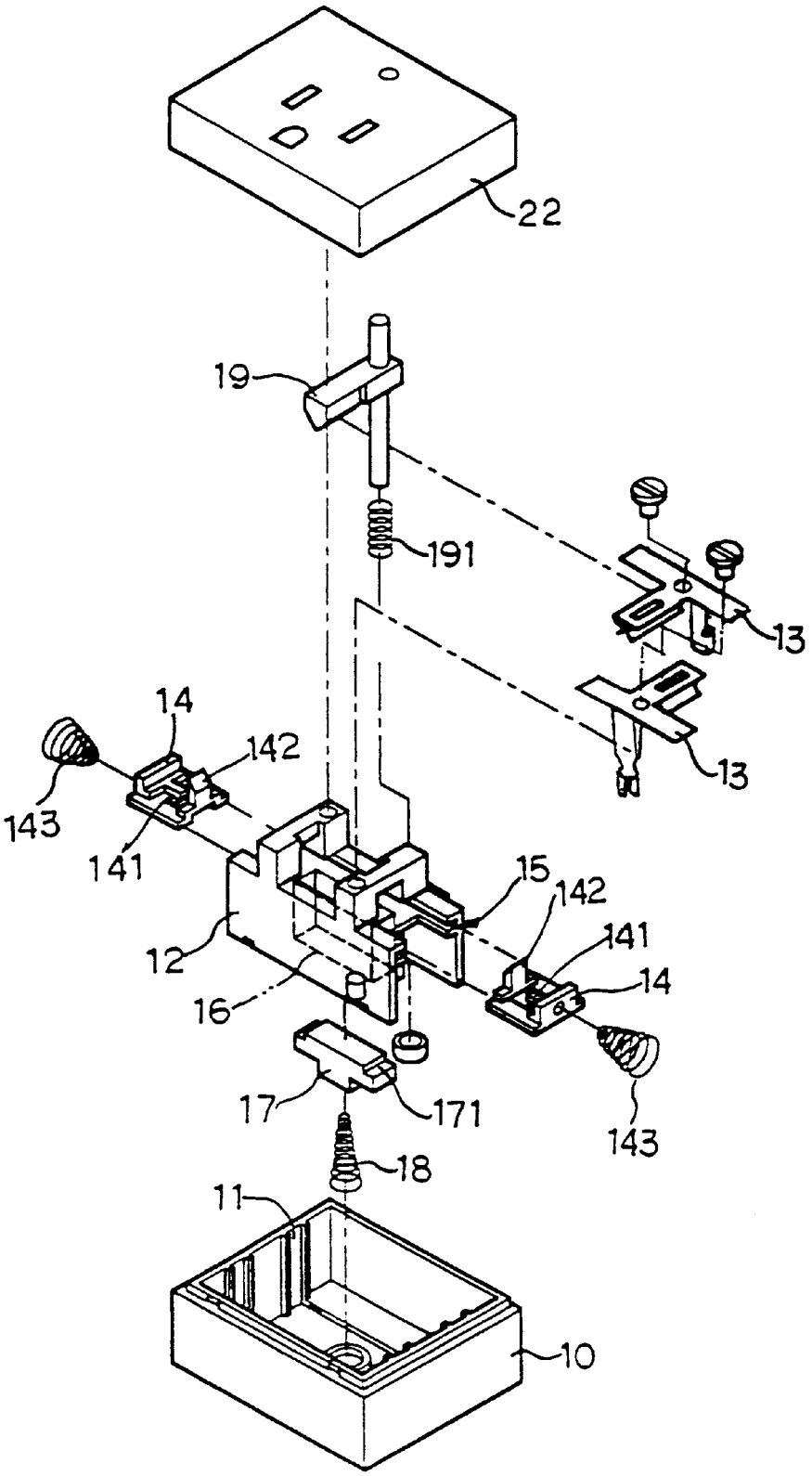
FIG. 1 is an exploded perspective view of the socket in accordance with the present invention.
Figure 3:
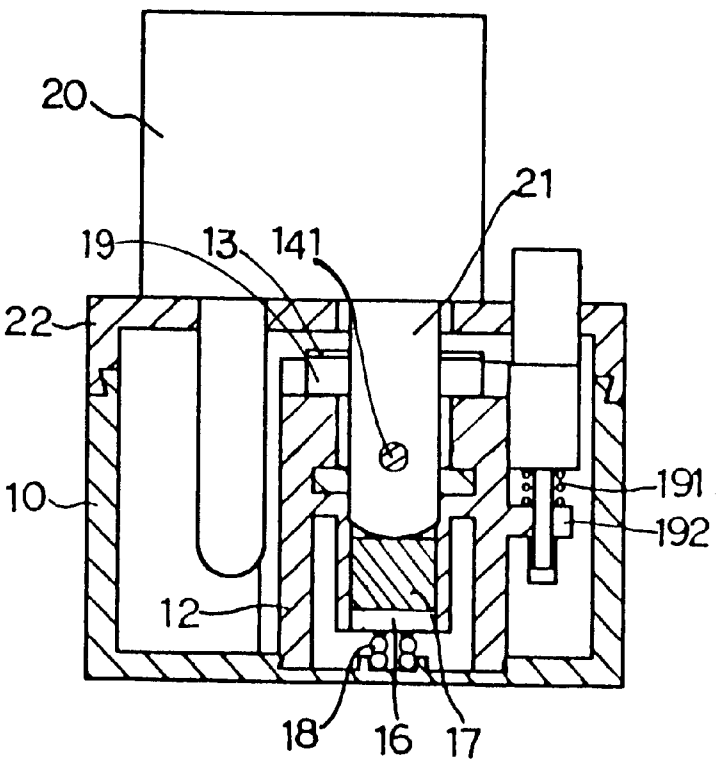
FIG. 3 is an elevational view showing a plug being mounted to the socket in accordance with the present invention.
Figure 2:
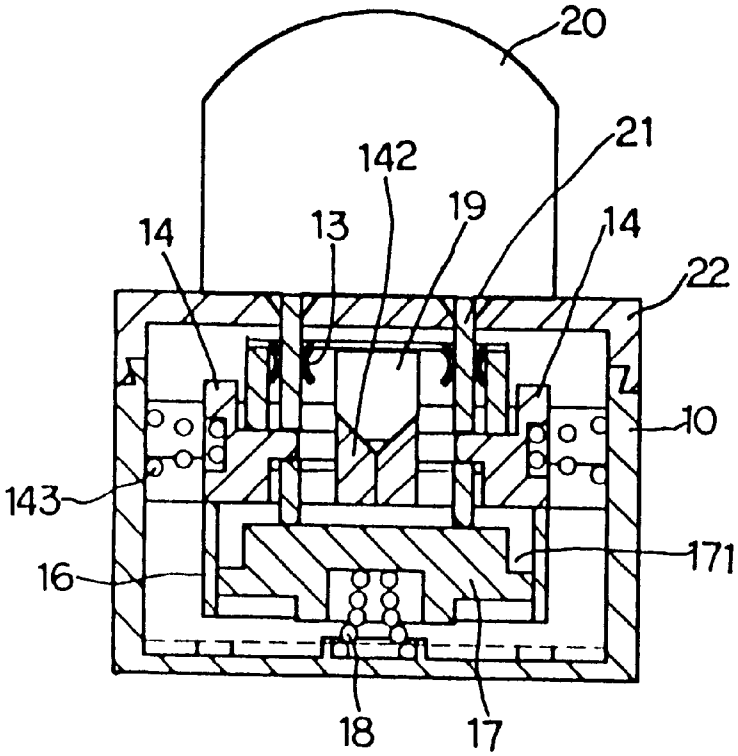
FIG. 2 is a schematic view showing a plug being mounted to the socket in accordance with the present invention.

Referring to the drawings of FIGS. 1 to 3 in greater details, the perspective exploded view of the socket of the present invention indicated generally in FIG. 1. The socket comprises a socket body 10, a framework 11 being mounted centrally within the body 10, a pair of conductive elements 13, a covering board 22, and a mounting seat 12.

Referring to FIG. 1, the socket body 10 is substantially a box-like hollow holder have a framework 11 being centrally mounted within the socket 10. The mounting seat 12 is provided with a pair of horizontal slots 15 at the central bottom region thereof for the positioning of the positioning disc 14. The mounting seat 12 is protruded above the edges of the framework 11 and is served as a base for the mounting of the conductive elements 13 and an earth wire (not shown) and the power source wire (not shown). At the bottom face of the mounting seat 12, a sliding slot 16 is provided. The horizontal slots 15 are used for the mounting of the positioning disc 14. The positioning disc 14 has a horizontal protruded end 141 and a stopping disc 142 being spaced apart from the protruded end 141. The stopping disc 142 has a slating edge. In combination, the positioning disc 14 is inserted into the horizontal slot 15. At the lateral end of the positioning disc 14, an elastic element 143 is provided. In accordance with the present invention, the elastic element 143 is a conic shaped spring which can be compressed into a planar shape. At the bottom face of the mounting seat 12, the sliding slot 16 is provided for an engaging board 17 to move within the slot 16 in an up and down direction. A conically shaped spring 18 is provided at the bottom face of the engaging board 17 to urge the engaging board 17 to elastically move upward and downward. At both ends of the engaging board 17, a step-like engaging end 171 is provided which facilitates the positioning member 14 to move sideway or laterally. The elastic element 18 at the bottom face of the engaging board 17 allows the engaging board 17 to restore to its original position and moves the board 17 to the top end of the sliding slot 16. In accordance with the present invention, the two engaging ends 171 can be exactly engaged at the bottom end of the positioning member 14, and are used as a positioning means during normal extended position. This position facilitates the insertion of the prongs 21 of a plug 20. The prongs 21 can be easily inserted into the socket to provide current from a power source (not shown).

In accordance with the present invention, the front edge of the positioning member 14 is the stopping disc 142 which works together with a pressing horizontal bar 19. The bar 19 is to be placed on the top of the stopping disc 142. One end of the bar 19 is perpendicularly mounted with a cylindrical rod such that the rod is divided into an upper section and a lower section. At the lower section of the cylindrical rod, a spring 191 is provided. The horizontal bar 19 is inserted into a flat plate 192 at the mounting seat 12 via a vertical hole. The vertical hole restricts the cylindrical rod so that it moves only up and down direction. The top face of the horizontal bar 19 is slightly protruded and touches the covering board 22. This facilitates the engaged prongs 21 to be disengaged from the socket by causing the positioning member 14 to move outward when the pressing horizontal bar 19 is pressed downward. The outward movement of the positioning disc 14 causes the member 14 to move away from the position for mounting the prongs 21. At such, the engaging board 17 moves upward by means of the elastic element 18 as a result of no blockage at the top position thereof and the elastic action of the elastic element 18. This causes the engaging ends 171 to engage at the bottom end of the positioning member 14.

Figure 4:
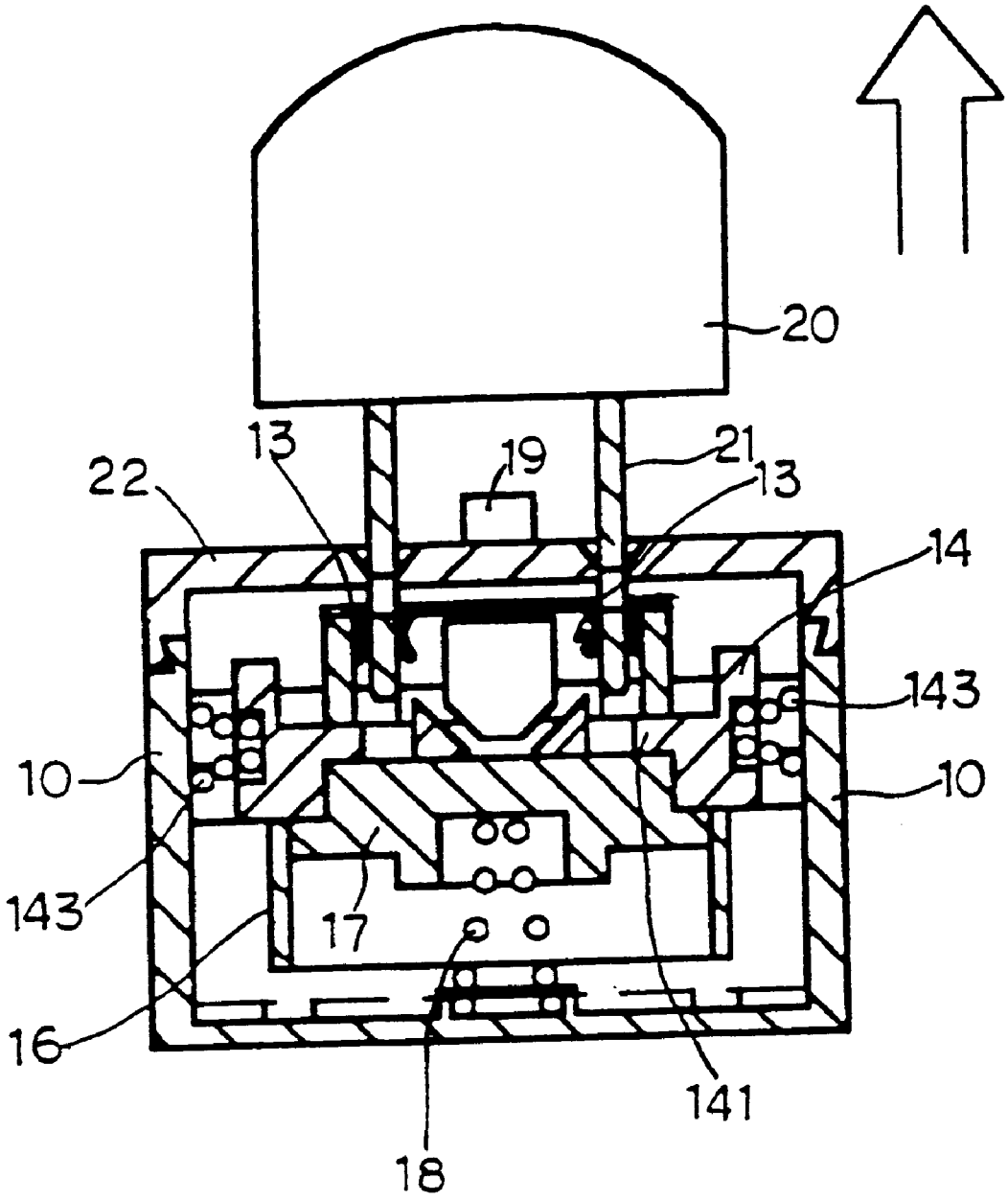
FIG. 4 is an elevational view showing the plug being withdrawn from the socket in accordance with the present inventions.

As shown in FIG. 4, the positioning member 14 being stopped from moving to the center of the socket body 10 allows the prongs 21 to be unplugged and also facilitates another plug in action. The insertion of the prongs 21 of a plug 20 into the socket are shown in FIGS. 2 and 3.

In accordance with the present invention, when the prongs 21 have been completely inserted into the socket body 10, the engaging board 17 is restricted to move downward. This allows the positioning member 14 to elastically clip the prongs 21 of the plug 20 and assures that the prongs 21 are securely mounted, and totally enclosed within the socket.

While the present invention has been described in detail, it should be understood that various changes, substitutions and alterations can be made hereto without departing from the spirit and scope of the invention as defined by the appended claims.

What is claimed is:

1. An improved structure of a sliding-type socket comprising a socket body, a mounting seat, a framework, a pair of conductive elements for connection to a power supply, and a horizontal bar being mounted below a covering board and onto the mounting seat, characterized in that a center of the socket body is provided with the framework for positioning of the mounting seat, the conductive elements are mounted at a top edge of the mounting seat and a horizontal slot is provided at the central bottom region of the mounting seat body for positioning of a positioning member, a front edge of the positioning member is extended to form a stopping disc, at a bottom face of the mounting seat, a sliding slot is extended for mounting of an engaging board which is urged by an elastic element, such that pressing of the horizontal bar causes the positioning member to slide laterally outward and to retract the engaging board to urge, and to position the positioning member, thus facilitating plug-in and unplug of prongs of a plug from the socket.

2. The socket as set forth in claim 1, wherein the positioning member is disposed at one or two lateral edge of the mounting seat.

3. The socket as set forth in claim 1, wherein a top face of the horizontal bar is protruded to touch an inner surface of the covering board.

4. The socket as set forth in claim 1, wherein an elastic element at a rear edge of the positioning member is a conically shaped spring.

5. The socket as set forth in claim 1, wherein two ends of the engaging board are provided with a step-like engaging end.

* * * * *